United States Patent [19]

Hengelmolen

[11] Patent Number: 5,049,067

[45] Date of Patent: Sep. 17, 1991

[54] SCRAP METAL RECYCLING FURNACE SYSTEMS

[75] Inventor: Adrianus J. Hengelmolen, Dreumel, Netherlands

[73] Assignee: Copermill Limited, Dunkirk, England

[21] Appl. No.: 380,972

[22] Filed: Jul. 17, 1989

Related U.S. Application Data

[63] Continuation-in-part of Ser. No. 170,792, Mar. 21, 1988, abandoned.

[30] Foreign Application Priority Data

Mar. 26, 1987 [GB] United Kingdom ..... 8707276
Dec. 24, 1987 [GB] United Kingdom ..... 8730099

[51] Int. Cl.[5] ..... C21B 9/10; F27D 17/00

[52] U.S. Cl. ..... 432/40; 432/181; 110/215

[58] Field of Search ..... 110/215; 432/181, 40, 432/254, 30

[56] References Cited

U.S. PATENT DOCUMENTS

| | | | |
|---|---|---|---|
| 1,900,396 | 3/1933 | Isley et al. | 432/181 |
| 1,943,957 | 1/1934 | Godard | 432/181 |
| 3,108,790 | 10/1963 | Agarwal | 432/40 |
| 3,180,629 | 4/1965 | Goeke et al. | 432/40 |
| 3,284,070 | 11/1966 | Nishida et al. | 432/40 |
| 3,509,834 | 5/1970 | Rosenberg et al. | 110/254 |
| 4,000,962 | 1/1977 | Hemingway et al. | 432/181 |
| 4,528,012 | 7/1985 | Sturgill | 432/181 |
| 4,651,655 | 3/1987 | Kunzel | 110/215 |
| 4,666,403 | 5/1987 | Smith | 432/181 |

*Primary Examiner*—Henry C. Yuen
*Attorney, Agent, or Firm*—Paul & Paul

[57] ABSTRACT

A scrap metal recycling furnace system comprises a dry hearth furnace, a closed well furnace, an afterburner chamber, a regenerator, a safety cooler and a fume purification plant operably interconnected by a plurality of conduits to form a system wherein exhaust gases from each component of the system can be selectively supplied to at least one other component of the system.

14 Claims, 5 Drawing Sheets

SCRAP METAL RECYCLING FURNACE SYSTEMS

This application is a continuation-in-part of U.S. patent application Ser. No. 07/170,792 filed 5/21/88, now abandoned.

The present invention relates to scrap metal furnace systems and more particularly to the improvement of the efficiency of furnaces used for the recycling of scrap metal.

In known scrap metal recycling furnace systems, hereinafter referred to as furnace systems, a single furnace is used and this furnace fluctuates in its heat output dependent on the cycling of charging. When charged it cools down and heats up as the cycle progresses being at its hottest prior to recharging. This is advantageous since the furnace walls will retain some heat but most of the heat will already have been lost via exhaust gases.

It is an object of the present invention to provide a furnace system incorporating at least two types of furnace which may be coupled together to produce a more efficient and more environmentally acceptable system.

According to the present invention there is provided a scrap metal furnace system including a dry hearth furnace and a closed well furnace and including means for using the exhaust gases from one of the furnaces to heat the other furnace.

Preferably the exhaust gases from both furnaces are fed to an after burner chamber in which heat is recovered from the exhaust gases and in which ambient temperature combustion air is preheated prior to being fed into one or more of the furnaces as combustion air for the material in the furnaces.

Preferably the after burner chamber comprises heat storage material which can be preheated by a furnace during a first period of time and which heat can be used to preheat the ambient combustion air during a second later period of time.

Preferably each furnace is supplied with its combustion air via an individual path through the after burner chamber and each path has a control valve on the inlet side of the after burner chamber.

Preferably an air/fuel balance control is provided for each air path to control the combustion in the particular furnace.

Embodiments of the present invention will now be described, by way of example with reference to the accompanying drawings, in which.

Figure 1:
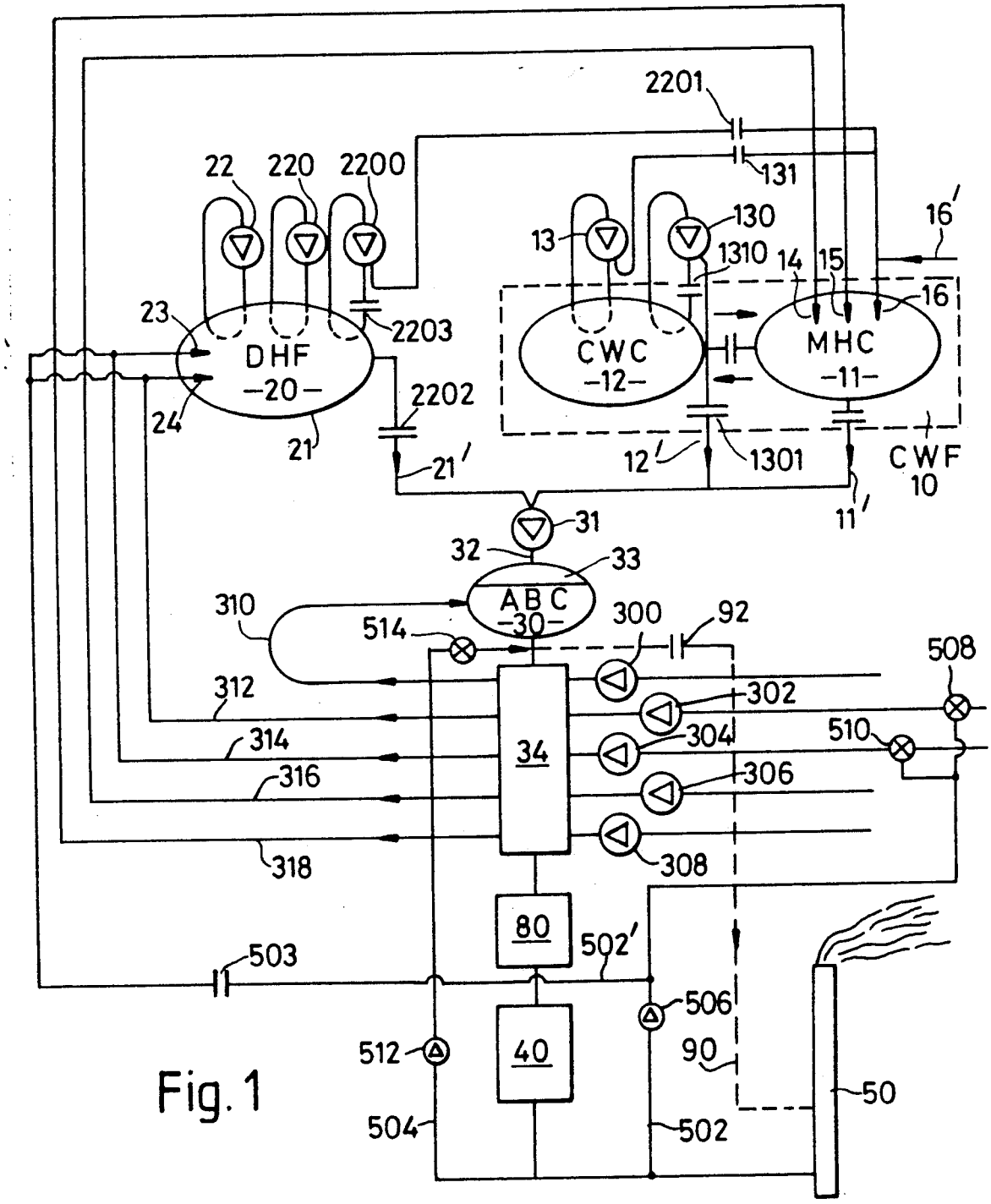
FIG. 1 shows diagrammatically a furnace system according to the present invention.

With reference now to FIG. 1 the furnace system comprises a Closed Well Furnace (CWF) 10 (shown in dotted outline) and a Dry Hearth Furnace (DHF) 20. In known manner the CWF 10 has two chambers, a main heating chamber (MHG) 11 and a Closed Well Chamber (CWG) 12.

Figure 5:
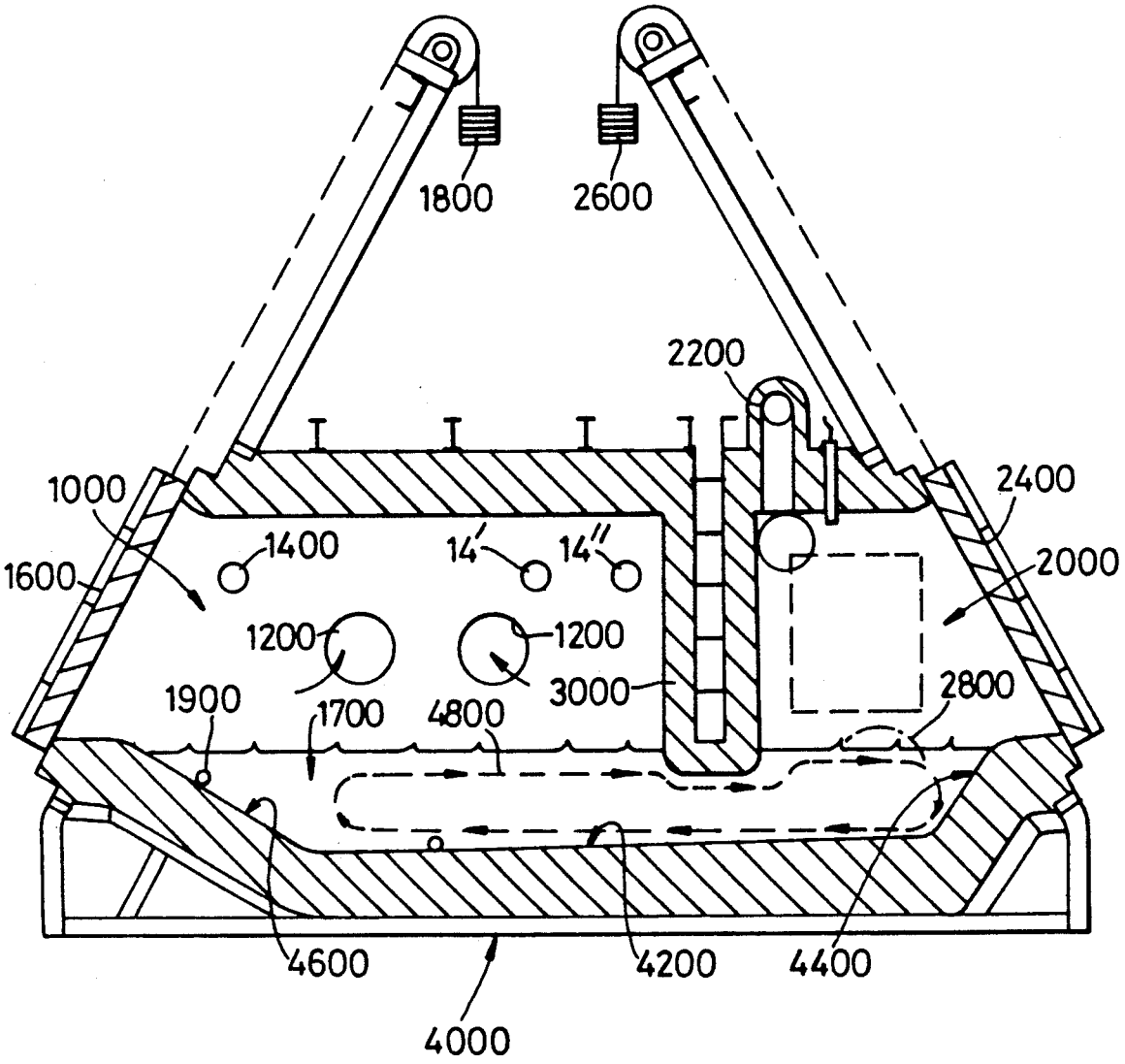
FIG. 5 shows in side elevation cross section a closed wall furnace suitable for use with the system of the present invention.

The Closed Well Furnace 10 is shown diagrammatically in FIG. 5 and its operation is briefly described as follows:

With reference to FIG. 5, the CWF furnace 10 comprises a main heating chamber 1000 and a closed well melting chamber 2000 separated by a dividing wall 3000 of refractory metal and preferably water or air cooled (not shown). The main heating chamber has exhaust outlets 1200 and heating burners 1400 and a sliding door 1600 preferably counterbalanced by a weight 1800. A tapped outlet 1900 is also provided controllable by any suitable valve means (not shown).

The melting chamber 2000 has an exhaust fume outlet 2200 and a sliding door 2400 preferably counterbalanced by a weight 2600. Aluminium scrap to be melted is placed into chamber 2000 via open door 2400 and the door is then closed to effectively seal the furnace.

The floor, walls and roof of the furnace are made from refractory material and doors 2400 and 1600 are also lined with refractory material. Heat loss through the walls etc. is kept to a minimum.

In the embodiment according to the invention as defined in our co-pending U.S. patent application Ser. No. 260,399 the longitudinal cross-sectional shape of the floor 4000 of the furnace is not rectangular as in the known closed well furnace. The floor 4000 is sloped from the melting bath chamber 2000 down towards the heating door 1600 end of chamber 1000. The slope of the floor over its centre portion 4200 is relatively shallow being preferably less than 5°. In a preferred embodiment the slope of the centre portion of the floor 4200 is about 3°.

At the end nearest the door 2400 the floor 4400 slopes steeply upwards to guide scrap metal 2800 (shown dotted) down onto floor portion 4200.

At the end nearest door 1600 the floor portion 4600 slopes less steeply to allow raking of the molten metal out of the chamber.

The slope of floor portion 4200 assists in providing a convection current (shown dotted) which circulates the molten metal in the path shown. The heated molten metal on the upper part of path 4800 therefore flows more rapidly past the scrap 2800 thereby melting the scrap at a greater rate than if the floor portion 4200 were horizontal. This is extremely advantageous since this considerably increases the throughput of the furance and hence its efficiency.

The scrap material 2800 to be melted in this type of furnace typically comprises aluminium or aluminium alloys of other metals which, if subjected to direct heat (such as in the dry hearth furnace 20) would oxidize and not melt correctly. Such scrap is typically comprised of soft drinks cans (normally crushed into a bale by a metal baling machine) which are made of valuable aluminium but which are of an extremely thin gauge of metal. If these cans were subjected to a direct flame such as the burner 1400 they would oxidize and this then presents an outer surface coating which prevents correct melting of the cans.

The closed well furnace 10 overcomes this problem by having the two compartments 1000 and 2000. Any direct heat required to maintain the melting process is provided by burner 1400 in the main heating chamber 1000. This heats up the molten liquid aluminium 1700, which circulates as shown by dotted line 4800 under the dividing wall 3000 and around the scrap 2800. The scrap 2800 is therefore primarily melted by immersion in a bath or molten liquid 1700. This prevents oxidisation of the thin aluminium walls of drinks cans, etc. and gives a good yield of good quality molten aluminium which can be made into ingots for subsequent re-use.

The furnace 10 requires, even with good insulation, a large amount of heat to be supplied by burners 1400. This is because the aluminium scrap produces very little heat (a small amount may be produced by paint or other coatings on the cans which will burn either in the furnace or in a regenerator (not shown)) and therefore substantially all the heat required to melt each batch of scrap must be supplied by the burners 1400. Thus the furnace 10 because of its method of operation is wasteful of heat and therefore environmentally undesirable.

Figure 6:
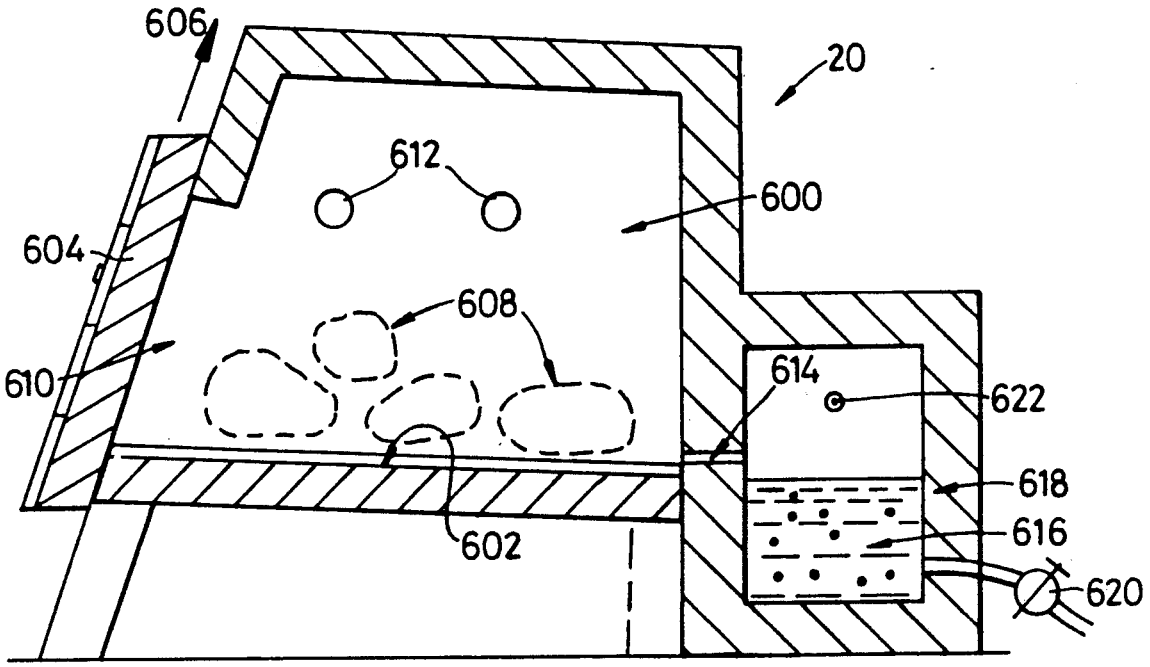
FIG. 6 shows a side elevation cross section a dry hearth furnace suitable for use with the system of the present invention.

With reference now to FIG. 6 a dry hearth furnace of a type suitable for furnace 20 is shown longitudinally in cross-sectional elevation. These furnaces are in wide scale use and therefore the furnace will only be described from the point of view of its operation.

The furnace 20 comprises a heating chamber 600 with a sloping floor 602. Access to the furnace is by a sliding door 604 (see arrow 606) which allows scrap material 608 (shown dotted) to be loaded into the furnace via opening 610 when door 604 is lifted.

Heat is supplied to furnace heating chamber 600 by burners 612 as and when required. The scrap material 608 is melted in chamber 600 and the molten metal 616 runs down the sloping floor 602, through a number of drainage holes 614 and is received in a collecting trough 618 from which it may be tapped via a suitable opening 620. Trough 618 may require heating to maintain the temperature of the molten metal 616 and a suitable small burner 622 is shown for this purpose.

The scrap 608 loaded into chamber 600 is often extremely dirty. For example scrap 608 may comprise whole engines with alloy parts (cylinder blocks, exhaust manifolds, alloy cylinder heads, etc.) or whole gearboxes with aluminium or aluminium alloy casings. This scrap when melted provides molten aluminium or aluminium alloy as liquid 616.

Alternatively furnace 20 can be used to melt down old electrical cables, the plastics insulation being present around the copper cable core.

In the case of engines, gearboxes, etc. they are usually still full of the old engine oil and this provides, once furnace 20 is brought up to temperature by burners 612, a source of heat to melt the aluminium (alloy) of scrap 608. The furnace is, therefore, under these circumstances, not only self sustaining but also is, in some circumstances, over productive of heat necessary to melt the scrap. This is particularly true during the period shortly after the furnace has been loaded with new scrap when the oil will burn extremely fiercely.

When the alloy parts of the engine, etc. have been melted the steel residue (gear wheels, shafts, etc.) is left on the floor 602 of the chamber and is removed by scraping it out of doorway 610 prior to the next charge being inserted.

The use of the furnace to melt down old cable creates similar, if not more extreme, problems. The coatings used in cables are usually plastics or rubber and this when burnt gives off extreme heat and enormous quantities of black smoke. Again shortly after each new charge of scrap is loaded into the furnace chamber 600 great heat and smoke is generated.

Under such conditions burners 612 are, of course, not switched on and excess heat is fed to suitable regenerators. This assists but does not entirely solve the problem when very dirty scrap is being melted because the heat generated within the heat regenerator is not required by the furnace. Also the regenerator can only burn up a limited quantity of the black exhaust gases per unit of time and if the exhaust gases are very dense then the exhaust from any regenerator will be unclean. This will require the use of a fume purification plant (not shown) which cools and purifies the exhaust gases. It may be easily seen that this is very wasteful of the heat generated by the dry hearth furnace because this heat must, in the above described circumstances, be dissipated in the regenerator and in the fume purification and not used for any useful purpose.

In an alternative situation, where for example old copper pipes, brass taps and other such articles require to be melted in the dry hearth furnace the opposite condition applies. Since this type of scrap is clean, burners 612 must be operated continuously to melt the scrap. During start up the regenerator, which supplies in known manner heated air to burners 612 will be cold and thus additional fuel will be required by burners 612 to melt the scrap. Thus it would be also advantageous in these circumstances if any heat regenerator could be maintained in a high temperature condition thus saving fuel burning in burners 612.

The present invention seeks to provide a solution to the problems described above associated with both the closed well and the dry hearth furnaces and to provide a furnace system which is more efficient and more environmentally acceptable than previous known scrap metal recycling furnace systems.

Flue gases from respective chambers 11 and 12 and from chamber 21 of DHF 20 are fed via respective flues 11', 12' and 21' to an after burner chamber (ABC) 30 via a blower 31 situated in a common flue line 32. The exhaust gases (assisted by blower 31) pass through ABC 30 and into a Fume Purification Plant (FPP) 40 before being exhausted to atmosphere via stack 50.

Two recirculatory blowers 13, 130 are used on CWC 12 to improve performance in known manner and three recirculatory blowers 22, 220 and 2200 are used on DHF 20 in known manner. These blowers reduce the pollutants in the exhaust gases from the furnaces.

In the present design two blowers are used on the closed wall chamber 12 and three on the dry hearth furnace 20. This enables the blowers to be all of the same (standard size thereby reducing complexity and cost.

Blowers 22 and 220 are connected to recirculate hot gases in known manner. They may, for example be controlled by a central control in accordance with the furnace temperature.

Blower 2200 has on its output flue a fork connection to the main heating chamber 11 of CWF 10 which is adjustable by a damper or valve 2201.

Blower 130 also has, on its output flue a fork connection to MHC 11 again controllable by a damper or valve 131.

Blower 130 also has, on its output flue a fork connection but connected to the main exhaust gas flue line 32 via a damper or valve 1301.

Combustion air (and if required fuel) is supplied to furnaces 10 and 20 via natural gas burners 14, 15 and 23, 24. The combustion air is blown by blower 31 and preheated by ABC 30.

After burner chamber ABC 30 comprises a natural gas heater stage 33 and a heat regenerator stage 34 through which the combustion air is passed to preheat it.

An emergency regenerator bypass route 90 is shown dotted and includes a valve 92 which when opened allows exhaust fumes to pass directly to stack 50.

The control system allows heat from any of the three chambers 11, 12 or 21 to be used to heat up the regenerator 34, if necessary after further heating in natural gas preheating stage 33. Incoming combustion air can then be preheated and directed as shown in FIG. 2.

Blowers 300 to 308 provide ambient air flow when operated through respective pipes 310 and 318 to the after burner recuperator 33, the DHF 20 and the MHC 11 at inlets 14, 15 the air received at these destinations being preheated by the regenerator 34. Thus heat is extracted from the exhaust gases and may be fed as required to one or more of three possible destinations dependent on the requirement for heating at these destinations. Thus exhaust gas from DHF 20 can, for example, be used to preheat, one regenerator 34, combustion air for the MHC 11.

A waste gas burner 16 is included in the MHC 11 which burns exhaust gases, with a high enough calorific content, from DHF 20 and/or CWC 12. This burner 16 may be assisted as indicated at 16' by a fuel (oil) burner which can be turned on when required for example when the exhaust gases from DHF 20 or CWC 12 are low in calorific value.

Figure 2:
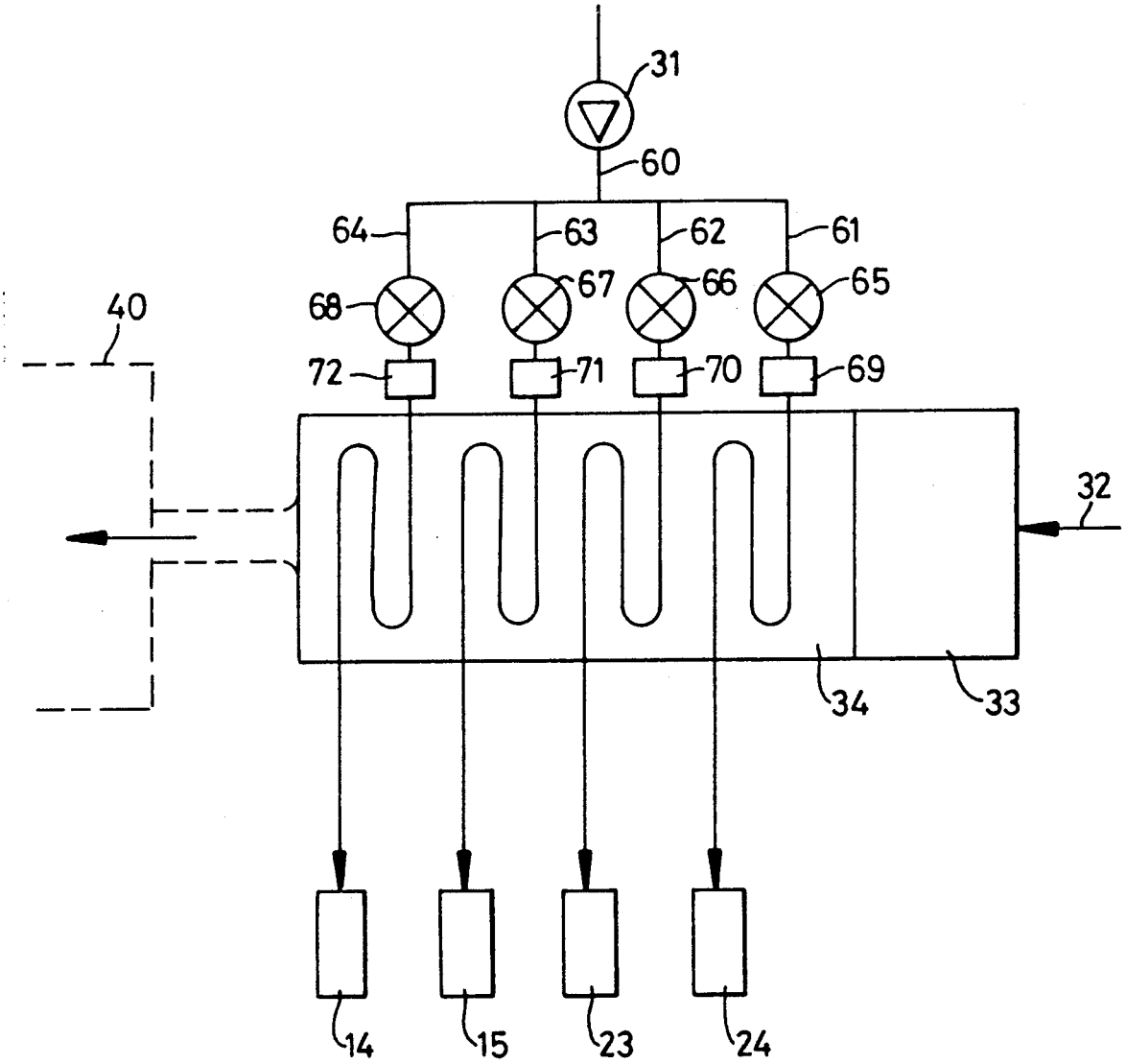
FIG. 2 shows diagrammatically the after burner air control arrangement in greater detail.

FIG. 2 shows an alternative system using a single blower 31'.

Blower 31' blows ambient temperature air via an inlet pipe 60 which then divides into four separate pipes 61, 62, 63, 64 each of which is controlled by a respective valve 65, 66, 67, 68 and each pipe has a defined path through regenerator 34 and then connects to respective burners 24, 23, 15 and 14 as shown. Each path is therefore individually controllable on the inlet side of the regenerator.

This design necessitates a control for each pipe to regulate the air/fuel mixture when fuel is being supplied to the burners. These controls are indicated by boxes 69, 70, 71, 72 which are identical in design and are shown in greater detail in FIG. 3.

Cold air blown by blower 31' is blown across a venturi 100 which dependent on the air flow causes a pressure drop which is detected by double sided diaphragm 101. The bellows of diaphragm 101 is connected to the bellows of a second diaphragm 102 which creates a pressure in the lower chamber 102' which pressure is compared in a differential pressure sensor 104 with the inlet air pressure and is used via diaphragm 105 and valve 106 to control the natural gas (fuel) supply on line 108 which in turn is fed to (for example) burner 24.

Valve 65 is controled for exampled in accordance with the temperature conditions of the furnace chamber as measured by thermocouple 110 which in known manner may be used to control the opening of valve 65 by drive motor 112.

Figure 3:
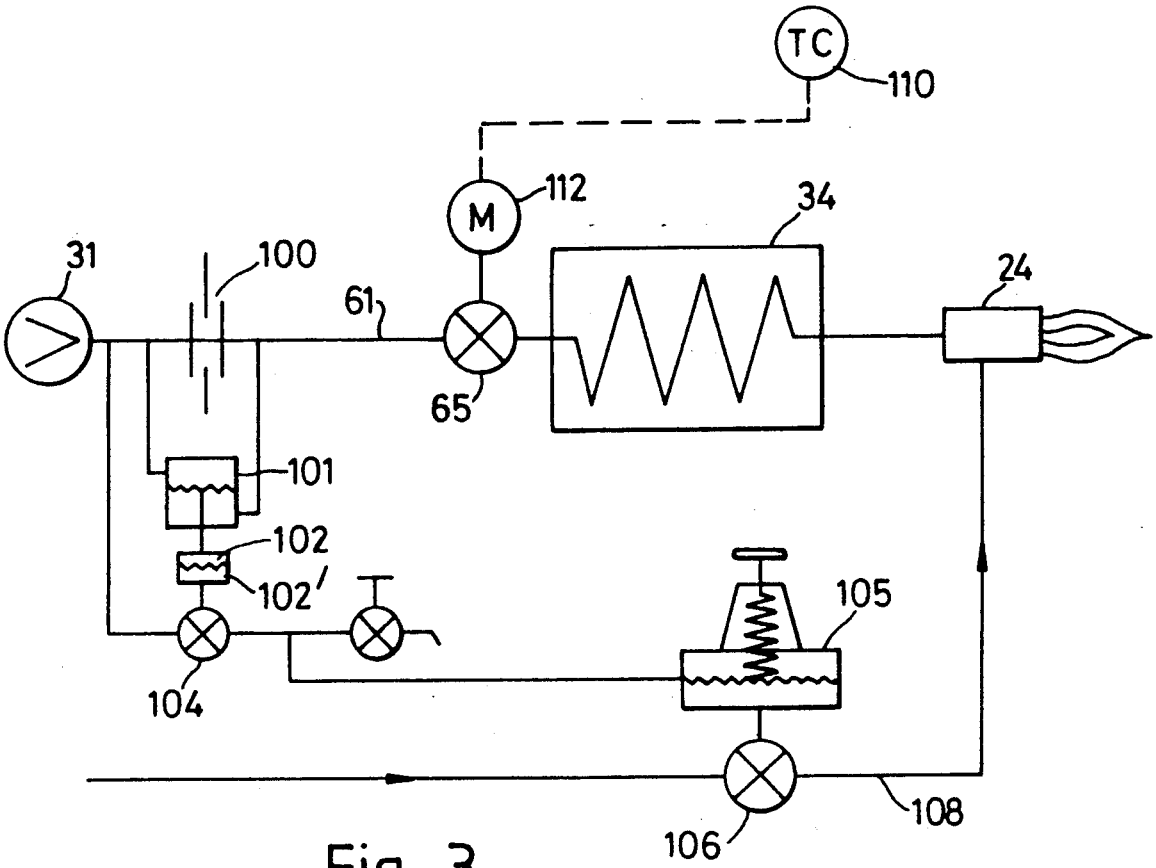
FIG. 3 shows a fuel/air control system for one of the furnace burners.

Thus the system of FIG. 3 controls the air/fuel mixture accurately for changes in ambient air temperatures to counter the chamber of air density at varying temperatures and valve 65 can be situated on the cold air side of regenerator 34.

The exhaust gases from the regenerator are fed via a safety cooler 80 to a fume purification plant 40 and then to stack 50. Optional by pass routes are shown in dotted line which may be used if for example the flue gases are too cold or particularly clean.

In FIG. 1 the blowers 2200 and 13 and 130 operate normally to recirculate the gases within the combustion chambers with valves 2201, 131 and 1301 fully closed. Thus closed well chamber 12 is isolated and also if valve 2202 on the exhaust outlet from DHF 20 is closed so is DHF 20.

If the gases in DHF 20 are of high calorific value then under central control these may be used to heat scrap in MHC 11 by opening valve 2201 and similarly gases in CWC 12 may be used to heat scrap in MHC 11 by opening valve 131.

If the gases in CWC 12 are not required then they may be exhausted to atmosphere by opening valve 1301.

A valve 2203 is included as shown in the circuit of blower 2200 and is shut when the door to DHF 20 is opened so that exhaust gases are fed to MHC 11 thereby reducing pollution when the furnace door is opened.

A further valve 1310 is included in the path between blower 130 and CWC 12 which is also closed when the door to the furnance is opened thereby ensuring that gases present in the closed well chamber are exhaused to stack 50 thus reducing pollution.

Further control of both the DHF 20 and also of the regenerator 34 is obtained in a modification which provides two paths 502, 504 for exhaust fumes exiting from the fume purification plant 40. These exhaust fumes are, in comparison with the normal atmosphere relatively oxygen deficient.

Thus by path 502 which includes an optional blower 506 and change over valves 508, 510 these oxygen deficient fumes can be fed into the DHF 20 via paths 312, 314. Valves 508, 510 can be controlled to allow only flow of fumes via paths 502, 312 and 314 or to allow blowers 302, 304 to pull in fresh air dependent on their position. A mixture of oxygen rich air and oxygen deficient fumes can easily be fed to DHF 20 by having valves 508, 510 in different positions thereby for example feeding oxygen rich air via path 312 and oxygen deficient fumes via path 314. This therefore provides further control over the combustion in DHF 20 and also thereby CWF10.

Path 502 also divides into path 502' which connects via valve 508 directly to the burners 23 and 24 thereby allowing oxygen deficient purified gases to pass to DHF 20 without being further heated in regenerator 34. This is particularly useful where the temperature in DHF 20 is high and where scrap with high calorific value is being burnt since it allows relatively cool gas to be fed into DHF 20 to continue the combustion process but at a reduced temperature.

Thus three paths are provided for burners 23, 24 to provide oxygen rich hot air, relatively oxygen deficient hot air of relatively oxygen deficient cooler air thereby providing good control for DHF 20.

Path 504 includes a blower 512 and stop valve 514 and allows oxygen deficient fumes to be fed into regenerator 34 for passage again through regenerator 34. Regenerator 34 is in a preferred design formed integrally with ABC 30 and the connection is then made where the gas from ABC 30 passes into regenerator 34 so that oxygen deficient relatively cool (e.g. 120° C.) gases can if required be mixed with the output gases from ABC 30. The circumstances under which this is beneficial is when the fumes entering ABC 30 are carbon rich and therefore the temperature achieved in ABC 30 may rise above a desired maximum say greater than 1200° C. If the temperature is allowed to rise then damage may be done to the regenerator 34 and to prevent this the relatively cool (120° C.) purified fumes from plant 40 are mixed with the output gases from ABC 30 to lower the temeprature of the combined gases entering regenerator 34.

In the above embodiments, as in the control of the furnace system as a whole the valves 508, 510; 514 and 503 and blowers 506 and 512 may be automatically operated under the control of sensors which measure the temperature in at least furnace DHF 20 and ABC 30 and that the temperatures can be controlled below safety margins.

Figure 4:
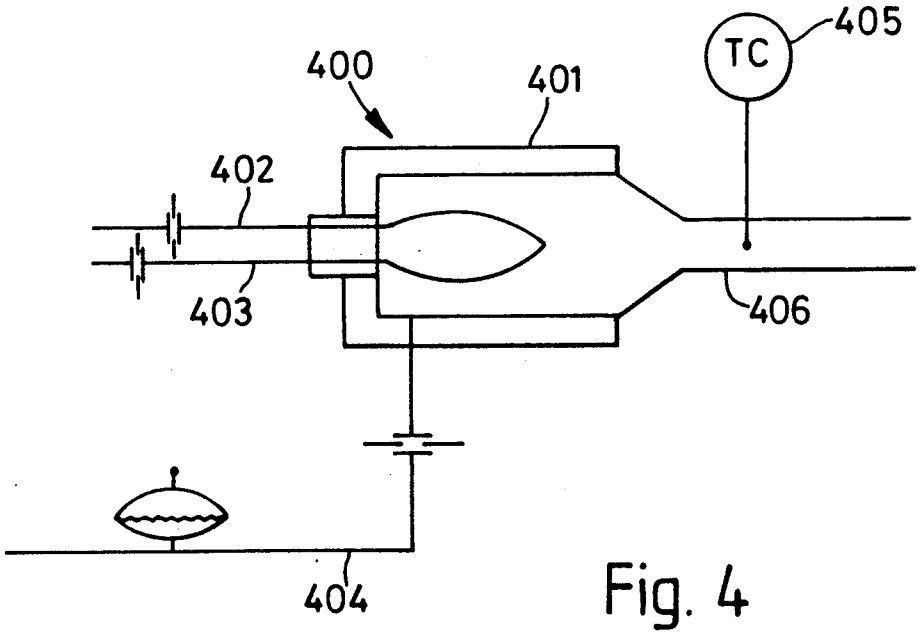
FIG. 4 shows an apparatus for determining the calorific values of an exhaust gas.

The calorific value of the gases in DHF 20 and CWC 12 may be measured using the apparatus of FIG. 4. In FIG. 4 a natural gas burner 400 in a casing 401 is fed with natural gas via line 402 and with excess combustion air via line 403. Exhaust gas is fed via line 404 which is bled off from a convenient position for example close to blower 130.

A thermocouple 405 is positioned at the exhaust outlet 406 of burner 400 and measures the exhaust temperature. If exhaust gas on line 404 is high in calorific content then the temperature sensed by thermocouple 405 will rise and this will be detected and the output voltage of thermocouple 405 can be used to signal a central control that calorific gas is available for the MHC 11 as required.

I claim:

1. A furnace system comprising, in combination:

a) a dry hearth furnace having a heating chamber and at least one burner for heating said chamber;

b) a closed well furnace having a main heating chamber and a closed well chamber, said main heating chamber and said closed well chamber being partially screened from one another by a refractory dividing wall, said main heating chamber having at least one primary burner and a secondary burner;

c) means for selectively supply exhaust gases directly from said dry hearth furnace to said secondary burner of said closed well furnace;

d) an afterburner chamber operatively connected to said dry hearth furnace and to said closed well furnace;

e) means for selectively supplying exhaust gases directly from said dry hearth furnace to said afterburner chamber;

f) means for selectively supplying exhaust gases directly from said closed well chamber of said closed well furnace to said afterburner chamber;

g) means for selectively supplying exhaust gases directly from said main heating chamber of said closed well furnace to said afterburner chamber;

h) a regenerator operatively connected to said afterburner chamber;

i) means for selectively supplying heated combustion air from said regenerator to said at least one burner of said dry hearth furnace;

j) means for selectively supplying heated combustion air from said regenerator to said at least one primary burner of said closed well furnace; and k) safety cooler operatively connected to said regenerator to receive and cool exhaust gases therefrom, a fume purification plant operatively connected to said safety cooler to receive and purify exhaust gases from said safety cooler, and an exhaust stack operatively connected to said fume purification plant to receive exhaust gases from said fume purification plant and emit said exhaust gases to the atmosphere.

2. The furnace system of claim 1, wherein each of said means for selectively supplying exhaust gases comprise conduit means defining a pathway for the flow of exhaust gases, valve means for selectively opening and closing said pathway, and blower means to facilitate movement of exhaust gases through said conduit means.

3. The furnace system of claim 1, wherein each of said means for selectively supplying heated combustion air comprise conduit means defining a pathway for the flow of combustion air, said conduit means being openable to a source of ambient air, valve means for selectively opening and closing said pathway, and blower means to facilitate movement of combustion air through said conduit means.

4. The furnace system of claim 1, further comprising means for selectively supplying exhaust gases from said fume purification plant to said at least one burner of said dry hearth furnace.

5. The furnace system of claim 4 wherein said means for selectively supplying exhaust gases from said fume purification plant to said at least one burner of said dry hearth furnace comprises conduit means defining a pathway for the flow of exhaust gases, valve means for selectively opening and closing said pathway and blower means to facilitate the movement of exhaust gases through said conduit means.

6. The furnace system of claim 1, further comprising means for selectively supplying exhaust gases from said fume purification plant to said regenerator.

7. The furnace system of claim 6, wherein said means for selectively supplying exhaust gases from said fume purification plant to said regenerator comprises conduit means defining a pathway for the flow of exhaust gases, valve means for selectively opening and closing said pathway, and blower means to facilitate the movement of exhaust gases through said conduit means.

8. The furnace system of claim 1, further comprising means for selectively supplying exhaust gases from said afterburner chamber directly to said exhaust stack.

9. The furnace system of claim 8, wherein said means for selectively supplying exhaust gases from said afterburner chamber directly to said exhaust stack comprises conduit means defining a pathway for the flow of exhaust gases and valve means for selectively opening and closing said pathway.

10. The furnace system of claim 1, further comprising means for measuring the calorific value of exhaust gases from said dry hearth furnace to said secondary burner.

11. The furnace systems of claim 1, further comprising means for selectively supplying exhaust gases directly from said closed well chamber of said closed well furnace to said secondary burner of said main heating chamber of said closed well furnace.

12. The furnace system of claim 11, wherein said means for selectively supplying exhaust gases directly from said closed well chamber to said secondary burner comprises conduit means defining a pathway for the flow of exhaust gases, valve means for selectively opening and closing said pathway, and blower means to facilitate the movement of exhaust gases through said conduit means.

13. The furnace system of claim 11, further comprising means for measuring the calorific value of exhaust gases from said closed well chamber to said secondary burner.

14. A furnace system comprising, in combination:

a) a dry hearth furnace having a heating chamber and at least one burner for heating said chamber;

b) a closed well furnace having a main heating chamber and a closed well chamber, said main heating chamber and said closed well chamber being partially screened from one another by a refractory dividing wall, said main heating chamber having at least one primary burner and a secondary burner;

c) means for selectively supplying exhaust gases directly from said dry hearth furnace to said secondary burner of said closed well furnace;

d) an afterburner chamber operatively connected to said dry hearth furnace and to said closed well furnace;

e) means for selectively supplying exhaust gases directly from said dry hearth furnace to said afterburner chamber;

f) means for selectively supplying exhaust gases directly from said closed well chamber of said closed well furnace to said afterburner chamber;

g) means for selectively supplying exhaust gases directly from said main heating chamber of said closed well furnace to said aferburner chamber;

h) a regenerator operatively connected to said afterburner chamber;

i) means for selectively supplying heated combustion air from said regenerator to said at least one burner of said dry hearth furnace;

j) means for selectively supplying heated combustion air from said regenerator to said at least one primary burner of said closed well furnace;

k) wherein each of said means for selectively supplying exhaust gases comprise conduit means defining a pathway for the flow of exhaust gases, valve means for selectively opening and closing said pathway, and blower means to facilitate movement of exhaust gases through said conduit means;

l) wherein each of said means for selectively supplying heated combustion air comprise conduit means defining a pathway for the flow of combustion air, said conduit means being openable to a source of ambient air, valve means for selectively opening and closing said pathway, and blower means to facilitate movement of combustion air through said conduit means;

m) a safety cooler operatively connected to said regenerator to receive and cool exhaust gases therefrom, a fume purification plant operatively connected to said safety cooler to receive and purify exhaust gases from said safety cooler, and an exhaust stack operatively connected to said fume purification plant to receive exhaust gases from said fume purification plant and emit said exhaust gases to the atmosphere;

n) means for selectively supplying exhaust gases from said fume purification plant to said at lesat one burner of said dry hearth furnace;

o) means for selectively supplying exhaust gases from said fume purification plant to said regenerator;

p) means for selectively supplying exhaust gases from said afterburner chamber directly to said exhaust stack; and q) means for measuring the calorific value of exhaust gases from said dry hearth furnace to said secondary burner from said dry hearth furnace;

r) means for selectively supplying exhaust gases directly from said closed well chamber of said closed well furnace to said secondary burner of said main heating chamber of said closed well furnace;

s) means for measuring the calorific value of exhaust gases from said closed well chamber to said secondary burner.

* * * * *